United States Patent [19]

Fowler et al.

[11] Patent Number: 4,893,541

[45] Date of Patent: Jan. 16, 1990

[54] PENTATONIC OCARINA

[76] Inventors: Ilania H. Fowler, P.O. Box 8381, Atlanta, Ga. 30306-0081; J. Charles Hind, 2301 West North Ave., Anderson, S.C. 29621

[21] Appl. No.: 190,402

[22] Filed: May 5, 1988

[51] Int. Cl.[4] ..... G10D 7/00

[52] U.S. Cl. ..... 84/380 C

[58] Field of Search ..... 84/380 C

[56] References Cited

U.S. PATENT DOCUMENTS

| | | | |
|---|---|---|---|
| 498,016 | 5/1930 | Stein | 84/380 C |
| 1,788,613 | 1/1931 | Bernard | 84/380 C |
| 2,145,605 | 1/1939 | Mausolf | 84/380 C |
| 2,194,332 | 3/1940 | Sumner | 84/380 C |
| 2,209,427 | 7/1940 | Swanson | 84/380 C |
| 3,815,466 | 6/1974 | Johnson | 84/380 C |

*Primary Examiner*—L. T. Hix
*Assistant Examiner*—Brian W. Brown
*Attorney, Agent, or Firm*—Richard C. Litman

[57] ABSTRACT

An ocarina includes a generally oval body enclosing a hollow chamber, a mouthpiece, a passageway connecting the mouthpiece and the chamber, a vent slot against which the air within the chamber may vibrate, and a plurality of pitch control holes. By covering or uncovering the pitch control holes with his or her fingers, the user of the ocarina can produce the notes of the pentatonic scale. Alternate embodiments of the ocarina can be produced for playing tones within the soprano, alto, tenor or bass tonal range. The device can also be configured to have three pitch control holes per enclosed chamber, or to include two enclosed hollow chambers of air, but in any configuration, the instrument can only produce the notes of the pentatonic scale.

7 Claims, 3 Drawing Sheets

PENTATONIC OCARINA

BACKGROUND OF THE INVENTION

1. Field of the Invention

The present invention relates in general to wind instruments which utilize a plurality of fingering holes to control the pitch produced by a substantially enclosed air chamber, and more particularly to a pentatonic ocarina.

2. Description of the Prior Art

A wide variety of simple hand-held wind instruments have been developed and patented over the years. The applicant believes that the following U.S. patents are representative of the relevant prior art.

U.S. Pat. No. 1,788,613 issued to Bernard discloses a wind instrument which can be mechanically adjusted to produce either full tones or half-tones. As stated in Claim 2 of the patent, however, this instrument is used to produce the notes of the chromatic scale.

U.S. Pat. No. 3,815,466 issued to Johnson discloses a fipple flute which includes a resonating chamber with four pitch control openings which is thereby able to produce an entire octave of the chromatic scale.

U.S. Pat. No. 2,145,605 issued to Mausolf discloses an ocarina which utilizes ten fingering holes to produce the notes of the scale. With this device, however, each note can only be produced by manipulating a particular fingering hole.

According to the *Encyclopedia of Music* by Norman Lloyd, published by the Western Publishing Company in 1971, which is hereby incorporated by reference, at pages 363–364, the ocarina: "[is] a plaintive-sounding relative of the woodwind family made of clay. Often called 'sweet potato' from its shape, it has a mouthpiece of a simple whistle type, so that the tone is easy to produce, and it has eight finger holes—four on each hand—underneath which are two thumb holes and a 'voicing' hole from which the air issues. The range of the ocarina is three tones larger than an octave; it comes in different sizes, each pitched in a different key. The larger the ocarina, the deeper the tone." This passage accurately describes the state of existing ocarina technology as represented by devices such as that disclosed in U.S. Pat. No. 2,145,605.

The present invention, however, is unique in that it is an ocarina which only produces the notes of the tonal G. anhemitonisch pentatonic scale. As stated at page 347 of *A Dictionary of Musical Terms,* edited by Stainer and Barr, cataloged in the Scientific Library of the Patent and Trademark Office as "ML 108.S74", which is hereby incorporated by reference, the pentatonic scale is; "The name given by Carl Engel to the ancient musical scale which is easiest described, as that formed by the black keys of the pianoforte. It consists of the 1st, 2nd, 3rd, 5th, and 6th degrees of a modern diatonic scale, e.g.,:

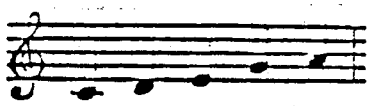

Furthermore, as stated in the *Encyclopedia of Music* at page 414: "Because the scale was used in countries outside Europe, there has been no pattern for the harmonization of the tones of the scale. In fact, because of the lack of half steps in the scale, any combination of tones can be sounded together. In their search for scales other than the conventional major and minor, both Debussy and Ravel lighted on the pentatonic scale and used it in their compositions."

In the context of music education, this property of the pentatonic scale, namely that any combination of notes within the scale will automatically harmonize with any other notes from within the scale, means that children playing instruments in the pentatonic scale, e.g., the black keys of a piano, or the present invention, will not produce half-tones, and hence the instrument will not produce discordant notes, which sound "wrong". This inherent property of the pentatonic scale helps encourage children to experiment and build their self-confidence with music and pentatonic instruments, secure in the knowledge that they will not be ridiculed for playing "wrong" notes.

SUMMARY OF THE INVENTION

The present invention discloses a wind instrument, commonly referred to as an "ocarina" which plays only the notes of the pentatonic scale.

It is a first object and advantage of the present invention to provide a wind instrument with an enclosed air chamber which is only capable of playing the tones of the pentatonic scale.

It is a further object and advantage of the present invention to provide a pentatonic ocarina which may utilize either two or three fingering holes per enclosed chamber to produce the tones of the pentatonic scale.

It is an additional object and advantage of the present invention to provide a pentatonic ocarina which can be formed to include two enclosed chambers, thereby allowing the user to produce two tones simultaneously, said tones being in harmony with each other.

DETAILED DESCRIPTION OF THE PREFERRED EMBODIMENT

Figure 1:
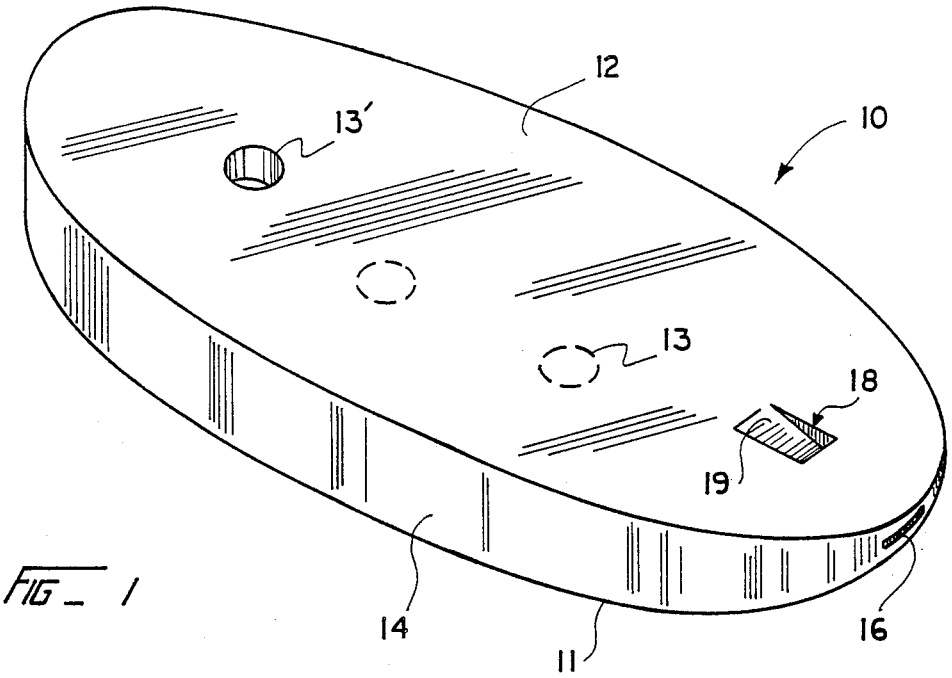
FIG. 1, is a perspective view of a version of the present invention suitable for playing the notes of the bass range. This view represents an alternative embodiment of the present invention having three pitch control holes in the enclosed air chamber. In this case two pitch control holes are positioned on the lower surface of the instrument and are shown in dashed lines.

Referring now to the drawing figures wherein like numbers refer to like elements throughout, the pentatonic ocarina 10 is shown. In the preferred embodiment, the ocarina is generally oval in shape and has a relatively flat lower surface 11, a relatively flat upper surface 12 within which the pitch control holes 13 and 13' are formed, and a vertical wall 14 joining together the upper 12 and lower 11 surfaces. As can be seen from the drawing figures, in most cases the pitch control holes 13 and 13' are positioned within the upper surface 12 of the pentatonic ocarina 10, but as can be seen in FIG. 1, showing a version of the present invention suitable for playing the notes of the bass tonal range, it may be advantageous to place one or more of the pitch control holes 13 and 13' on the lower surface 11 of the pentatonic ocarina 10.

Figure 2:
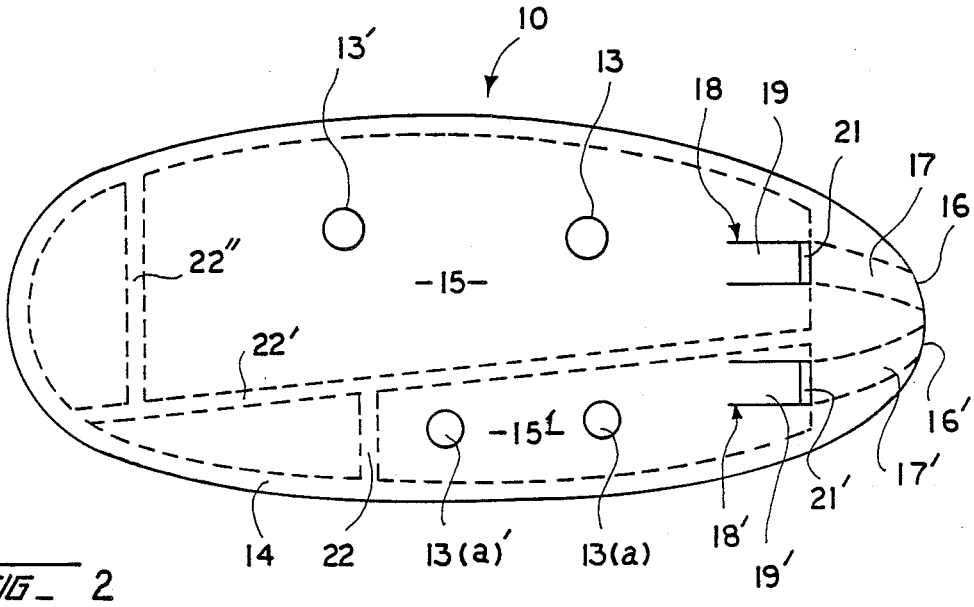
FIG. 2, is a top plan view in cross-section of a version of the present invention suitable for playing the notes of the tenor range. This version of the present invention includes two enclosed chambers and two windways. The interior walls which separate the two enclosed chambers are shown in dashed lines.
Figure 5:
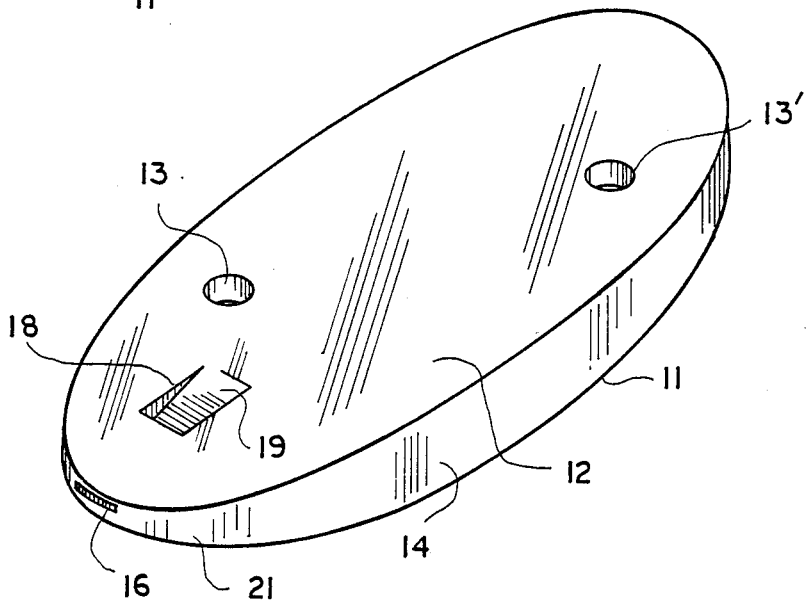
FIG. 5, is a perspective view of a version of the present invention suitable for playing the notes of the alto range.
Figure 6:
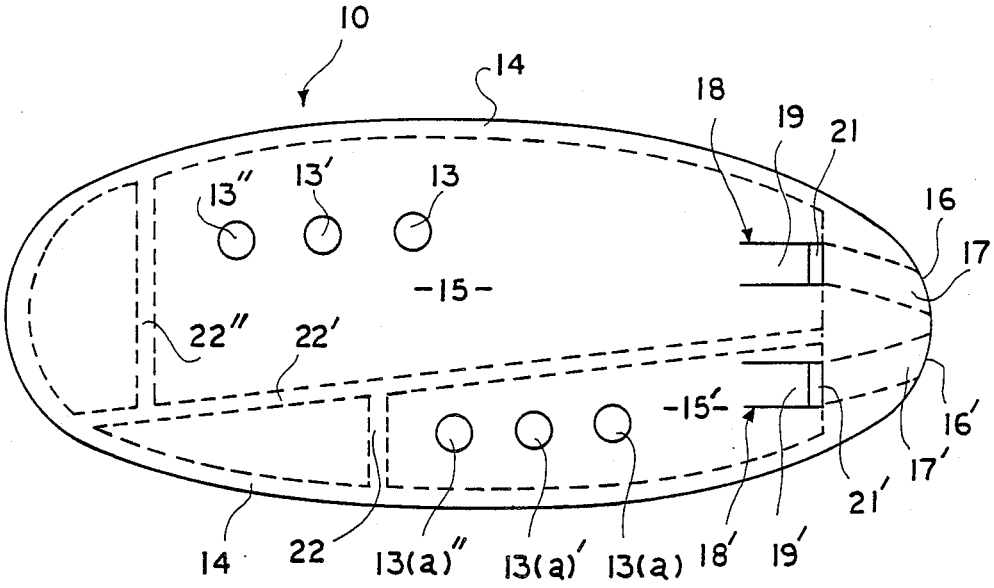
FIG. 6, is a top plan view in cross-section of an alternate embodiment of the present invention. This figure represents a pentatonic ocarina having two enclosed air chambers suitable for playing the tones of the tenor tonal range. This figure also represents a version of the present invention having three pitch control holes per enclosed air chamber.

The upper 12 and lower 11 surfaces, together with the vertical wall 14 of the device 10, serve to close off a chamber of air (shown as 15 and 15' in the double chambered tenor version of the present invention as shown in FIG. 2). This oval shape is clearly easy to work with and reproduce, but as will be appreciated by those skilled in the relevant art, various other shapes could be utilized—the total volume of enclosed air is the most important consideration—the exterior instrument shape used to capture this volume of air is not important. For example, it may be advantageous to form the alto version of the present invention (as shown in FIG. 5) in the shape of a turtle and to form the tenor version of the present invention (as shown in FIGS. 2 and 6) in the shape of a duck to facilitate easy correlation of the different instruments and their tonal ranges by younger students.

Figure 4:
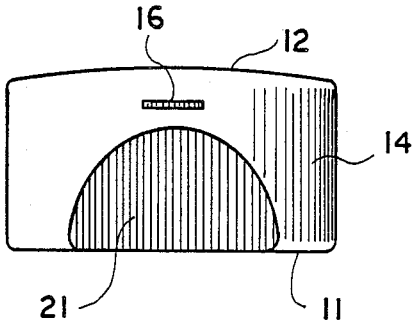
FIG. 4, is an end view of the present invention showing the mouthpiece of the pentatonic ocarina.

As is best seen in FIG. 4, a mouthpiece 16 is formed at one end of the pentatonic ocarina 10 in order to allow the user to supply air to the enclosed chamber 15 of the device. As is best seen in FIGS. 2 and 6, the mouthpiece 16 is provided with two windways 17 and 17' which lead from the outside of the vertical wall 14 into the enclosed chambers of air 15 and 15'. Obviously, those versions of the pentatonic ocarina 10 having only one enclosed air chamber 15, will only have one windway 17 leading inwardly through the mouthpiece 16.

A vent slot 18 is also disposed within the upper surface 12 of the ocarina 10. As is best seen in FIGS. 2 and 6, the vent slot 18 includes a labium 19 against which the excited air (which is set into motion when the user blows air through the windway 17 of the mouthpiece 16 of the ocarina 10) vibrates and thereby allows the ocarina 10 to produce the various tones (the specific pitch produced by the ocarina is of course controlled by the pitch control holes 13 and 13' as will be more fully discussed hereinafter). The vent slot 18 also includes a rectangular aperture 21 through which air may leave the enclosed chamber 15 of the ocarina 10 while the user is playing the instrument.

Figure 3:
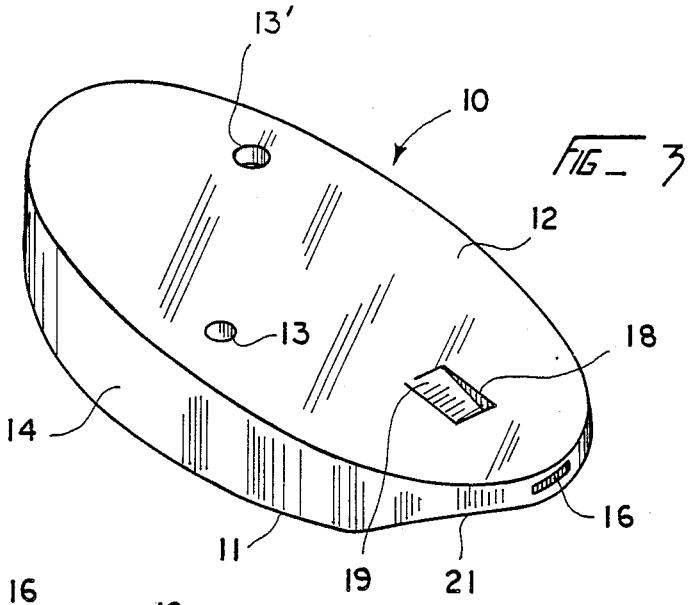
FIG. 3, is a perspective view of a version of the present invention suitable for playing the notes of the soprano range.

As is best seen in FIGS. 3 and 4, in the preferred embodiment, the ocarina 10 is equipped with a sloped surface 21 running from beneath the windway 17 to the lower surface 11 of the ocarina 10. The sloped surface 21 can be considered to be part of the mouthpiece 16 in that it facilitates insertion of the instrument 10 into the user's mouth. Obviously other configurations could be utilized, but this sloping surface 21 makes it easy for persons of all ages to play the instrument.

As stated previously, the pentatonic ocarina 10 can be manufactured to produce differing ranges of tones. The different versions of the ocarina 10 vary primarily in the size of the pitch control holes 13 and 13' and in the size of the chamber of air 15 enclosed within the ocarina 10. The following musical staffs represent the tonal ranges produced by a representative selection of the pentatonic ocarinas which have been produced by the present inventors. Clearly, different versions of the pentatonic ocarinas of the present invention could be fabricated in order to produce differing tones while still remaining within the scope of the present invention. As discussed earlier, the crucial feature of the pentatonic scale is the intervals between the notes of the scale, not the point on the staff at which the scale is initiated. The following examples of the present invention, for example, were fabricated to play all sharps, and in this way these instruments allow even a novice music teacher to easily lead a class of students playing pentatonic ocarinas 10 by simply playing the black keys of the piano. Clearly, however, the instruments could be fabricated to play other tones within the pentatonic scale.

EXAMPLES OF TONAL RANGES PRODUCED BY THE PRESENT PENTATONIC OCARINA

Soprano (as shown in FIG. 3):

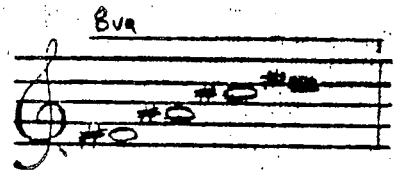

Alto (as shown in FIG. 5):

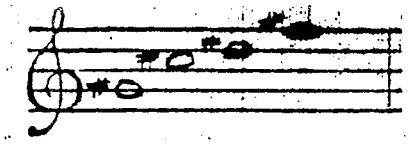

Tenor (two chambered version as shown in FIG. 2):
Enclosed Air Chamber Controlled by the Left Hand:

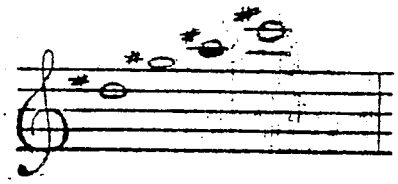

Enclosed Air Chamber Controlled by the Right Hand:

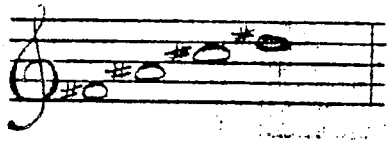

Bass (version having three pitch control holes as shown in FIG. 1—the tone produced by the third pitch control hole 13'' is shown to the right of the vertical measure bar):

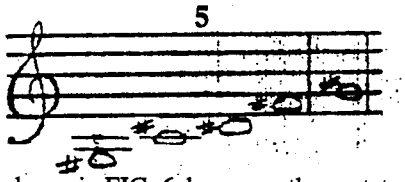

As is shown in FIG. 6, however, the pentatonic ocarina 10 of the present invention can also be formed with three, rather than two, pitch control holes 13, 13' and 13''.

As best seen in FIGS. 2 and 6, the pentatonic ocarina 10 of the present invention can also be manufactured such that the instrument has two enclosed air chambers 15 and 15'. Any version of the pentatonic ocarina (e.g., soprano, alto, tenor, or bass) can be produced having to enclosed air chambers 15 and 15'. As is best seen in FIGS. 2 and 6, a doubled chambered version of the ocarina 10 will also have two windways 17 and 17', two vent slots 18 and 18', and two sets of pitch control holes 13 and 13' and 13(*a*) and 13(*a*)' (or in the case of the three-holed version of the pentatonic ocarina as shown in FIG. 6, 13, 13' and 13'' and 13(*a*), 13(*a*)' and 13(*a*)''). In the doubled chambered version of the pentatonic ocarina, as is best seen in FIGS. 2 and 6, the enclosed air chambers 15 and 15' are separated from each other by interior walls 22, 22' and 22''. In this way, because of the dual arrangement of the pentatonic ocarina having two enclosed chambers of air 15 and 15', a person blowing into both windways 17 and 17' of this version of the device, can play two-part harmonies by himself.

As has been previously stated, a variety of shapes can be used to produce the body of the pentatonic ocarina, it is important, however, that only two or three pitch control holes 13, 13' and 13'' be placed within any one enclosed chamber 15 in order to maintain the essential feature of the present invention, namely its ability to produce the notes of the pentatonic scale—and no other.

The above description is intended as illustrative only, and is not intended to limit the scope of the present invention in any way, and hence any variation lying within the scope of the appended claims may be resorted to.

We claim:

1. A wind instrument for producing the tones of a specific pentatonic scale, comprising:

an enclosed instrument body having an upper surface, a lower surface, and a wall defining the joining of said upper and lower surfaces, said body enclosing one or more hollow interior chambers;

a mouthpiece located on said wall;

a vent slot in each of said one or more interior chambers disposed within said upper surface of said body and offset from said wall;

a wind passageway having an inlet opening in said mouthpiece and an outlet opening within each of said one or more interior chambers of said instrument body adjacent to said vent slots, said passageway shaped to direct air blown through said mouthpiece against a bottom edge of said vent slot, whereby air within said one or more hollow interior chambers is caused to vibrate; and a plurality of at most three per chamber pitch control holes disposed within said upper or lower surfaces of said instrument body whereby, when any selected one or more said holes are opened and closed while air is blown through said mouthpiece and into said instrument body, only notes of said specific pentatonic scale may be produced.

2. The wind instrument of claim 1, wherein said upper surface of said instrument body includes two of said pitch control holes per said hollow interior chamber.

3. The wind instrument of claim 1, wherein said upper surface of said instrument body includes three of said pitch control holes per said hollow interior chamber.

4. The wind instrument of claim 1, wherein said instrument body includes two of said wind passageways, two of said vent slots, and two of said enclosed hollow chambers within the interior of said instrument body.

5. The wind instrument of claim 1, wherein said lower surface of said instrument body includes at least one of said pitch control holes.

6. The wind instrument of claim 1, wherein said specific pentatonic scale is a tonal G. anhemitonisch pentatonic scale.

7. The wind instrument of claim 1, wherein said specific pentatonic scale has no semitones.

* * * * *